United States Patent [19]

Chap

[11] 4,446,642

[45] May 8, 1984

[54] PERIPHERAL DECORATIVE ARTICLE

[75] Inventor: John P. Chap, Lemont, Ill.

[73] Assignee: Selfix, Inc., Chicago, Ill.

[21] Appl. No.: 431,816

[22] Filed: Sep. 30, 1982

[51] Int. Cl.[3] ..... G09F 1/12

[52] U.S. Cl. ..... 40/152.1; 40/154; 248/223.4

[58] Field of Search ..... 40/152, 152.1, 158 R, 40/158 B, 154, 156, 157, 159, 110, 153; 273/425; 206/303; 301/37 C, 37 P, 37 T; 220/306, 307, 308; 16/42 T, 42 R; 24/3 E, 3 F, 297, 113 MP, 3 B; 248/223.4, 225.1, 224.2

[56] References Cited

U.S. PATENT DOCUMENTS

| | | | |
|---|---|---|---|
| 2,654,113 | 10/1953 | Becker | 24/113 MP |
| 3,262,170 | 7/1966 | Gill | 24/113 R |
| 3,822,494 | 7/1974 | Zivica | 40/154 |
| 3,898,870 | 8/1975 | Jacobsen | 40/152 |
| 4,244,127 | 1/1981 | Buzzard | 40/152.1 |

*Primary Examiner*—Robert Peshock
*Assistant Examiner*—Kris R. Schulze
*Attorney, Agent, or Firm*—Dressler, Goldsmith, Shore, Sutker & Milnamow, Ltd.

[57] ABSTRACT

A peripheral decorative article such as a framing member adapted to be disposed around an article to be framed which is formed integrally and incorporates an inner article engaging portion adapted to frictionally engage the outer surface of the article being framed and having sufficient flexibility to permit insertion of the framing member over the article and sufficient resiliency to retain the framing member in place without incidental movement thereon with respect to the article being framed.

8 Claims, 6 Drawing Figures

PERIPHERAL DECORATIVE ARTICLE

FIELD OF THE INVENTION

The present invention relates to decorative articles adapted to fit around the periphery of a variety of objects and in particular to a decorative framing member adapted to fit around the periphery of objects attached to a wall or other mounting surface.

BACKGROUND OF THE INVENTION

It is widely recognized that the appearance of many articles can be dramatically enhanced as a result of or by virtue of the use of a peripheral decorative article such as a framing member or frame surrounding the article.

Most articles that are framed, are somewhat permanently installed into the frame or otherwise affixed to the frame prior to and independently of installation on the surface on which the article is to be mounted. This by the very nature of the framing process, renders the framing member and article somewhat permanently interrelated so that changing or modifying the appearance of the frame can sometimes be quite difficult.

There are occasions where it may be desirable to alter or change the framing member to blend it in with or render it compatible with changing decor of the room or space in which it is located. There are also occasions when the article itself is to be changed and it would be desirable to provide the capability of framing the new article with the frame which previously had been applied to an old article. Furthermore, it would be desirable for a number of mass produced inexpensive articles to have available a variety of framing members from which to choose and which could be readily placed around the article to be framed.

SUMMARY OF THE INVENTION

In accordance with the present invention, there is provided a peripheral decorative article in the form of a framing member adapted to be placed around an article to be framed and be retained in place without the necessity of any external fasteners or attachment devices.

The decorative framing member incorporating the present invention is designed to snap-on and to be frictionally retained in place when in its desired position. At the same time the decorative framing member is readily displacable to permit insertion and removal of the frame around the object being framed smoothly and easily without excess effort resulting from too much friction or interference.

The decorative snap-on framing member incorporating the present invention is provided with a decorative face or front surface, and a decorative outer surface. In addition, the frame incorporates a flexible, inner, object contacting surface portion defining therewithin an opening for the object to be framed.

The inner contact portion is spaced apart a distance which is partially less than the size of the object being framed. This spacing, which will be for convenience referred to as the ID of the framing member (for inner diameter or inner dimension since the object being framed need not be circular and technically therefore need not have a diameter) defines the inner transverse dimension between the flexible contact surface portions.

To accomodate variations in the size of the article being framed, the flexible contact surface portions of the framing member define an ID which varies between a value that is not less than the maximum corresponding dimension of the object to be framed and about which the frame is to fit, and a value which is less than the smallest corresponding dimension of the article be framed. In order to provide the desired ID, and yet allow the frame to pass smoothly and easily over the object being framed, the flexible contact surface portion is desirably tapered from its maximum ID wherein the dimension is not less than the maximum corresponding dimension of the object being framed to a dimension which is less than the minimum dimension of the object being framed.

Thus, when the smaller ID of the flexible contact surface engages the object being framed, it deflects outwardly to permit passage of the frame member over the periphery of the framed object. Because of its tapered configuration, the inner flexible contact surface portion tends to press against the outer surfaces of the framed object causing the frame to be retained in place as it is positioned about the object being framed.

The object being framed may be mounted on a surface such as a wall prior to framing, in which case the wall itself can act as a natural stop so that the decorative article cannot be pushed over and passed the object being framed. When on the other hand, the framing member is being positioned before the object is attached to such a surface, it may be desirable to incorporate as a part of the framing member a stop so that it is automatically properly positioned when inserted over the object being framed.

Another aspect of the framing member incorporating the present invention is that it is movable from one side of the object being framed to the other and back again to permit installation over the framed article under a variety of different circumstances. For example, there are articles such as hooks in which the framing member must be initially placed on the article from the back of the article prior to installation on a surface, after which the framing member must be displaced toward the rear of the article and against the surface in its ultimate position.

More specifically, the framing member incorporating the present invention may typically be formed with a decorative front or facing surface, a decorative outer surface having a variety of geometric shapes and a inner contacting surface having a shape corresponding to the shape of the article to be framed. The inner contacting surface portion combines flexibility and resiliency so that when inserted over the object being framed, the contacting surface deflects outwardly in response to engagement with the article and as it is located in its final position the resilient contact surface may return at least partially towards its undeflected position to extent permitted by the article to frictionally engage the article thereby holding the framing member in position against accidental displacement while simultaneously permitting desired displacement in response to a not excessive manually applied displacement force.

The selection of the configuration of the contact surface provides an appropriate interference fit, an appropriate force between the contact surface and the article being framed, and an appropriate flexibility and resiliency to permit deflection of the contact surface portion during installation. To provide for a proper interference fit, as indicated above, the contact surface is typically configured at an angle with the free ends of the surface tapering towards the article being framed.

One convenient way of determining the angle of the taper of the contact surface is to construct it in accordance with the formula:

$$L=(POD_{max}-POD_{min})/(0.35\times h)$$

where

L equals the angle of the contact surface for a proper interference fit;

$POD_{max}$ is the maximum dimension of the outer surface of the product being framed which is intended to engage the contact surface;

$POD_{min}$ is the minimum dimension of the identical product surface; and

H is the height of the contact surface of the product. The numerical factor represents the rise per degree per inch of 0.0175" doubled for both sides of the contact surface portion.

While it has been imperically determined for one embodiment of the decorative article incorporating the present invention that a holding force of about six pounds satisfactorily retains the framing member on the product being framed without inadvertent movement and displacement while simultaneously not requiring excessive force for installation, in order to obtain such a suitable holding force, the thickness of the contact surface can be determined in accordance with the following formula:

$$T=(2\times F_{max})/(S\times FS)$$

where

T equals the thickness of the material forming the contact surface of the framing member;

$F_{max}$ equals the maximum holding force required;

S equals the surface area of the contact surface; and

FS equals the flex strength in psi/in$^2$ to break or yield.

In order to provide for flexibility of the contact surface, in a noncurvilinear configuration, the contact surface should be split at least at the corners to provide for flexibility. It may also be desired to configure the contact surface into a plurality of discrete segments or tabs to enable the contact surface to conform to surface irregularities of the product being framed. If the framing member contact surface is curvilinear, the tabs should be spaced apart about one half of the curve radius.

If more tabs are used, the surface contact between the contact surface and the article being framed will be reduced thereby increasing the flexibility of the contact surface tabs and reducing the holding force. Fewer tabs will increase the stiffness of each tab resulting in increased force and reduced flexibility which increases the likelihood of failure of the tabs.

Numerous other advantages and features of the present invention will become readily apparent from the following detailed description of the invention and the embodiments thereof, from the claims and from the accompanying drawings in which the details of the invention are fully and completely disclosed as a part of this specification.

DESCRIPTION OF SPECIFIC EMBODIMENT

Figure 1:
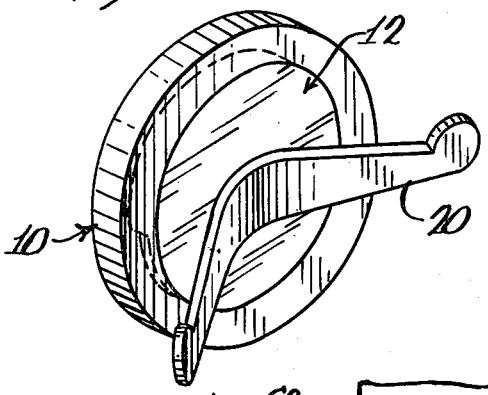
FIG. 1 is a perspective view of a framing member incorporating the present invention assembled on an article to be framed.
Figure 2:
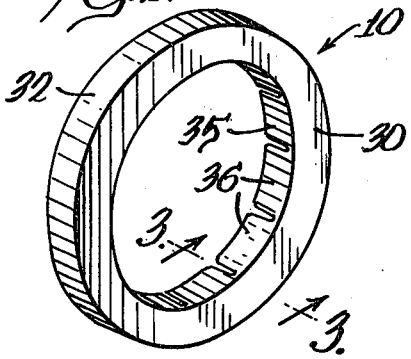
FIG. 2 is a perspective view of one embodiment of a framing member incorporating the present invention.
Figure 3:
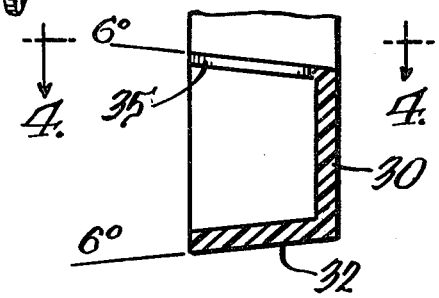
FIG. 3 is a sectional view taken along lines 3—3 of FIG. 2.
Figure 4:
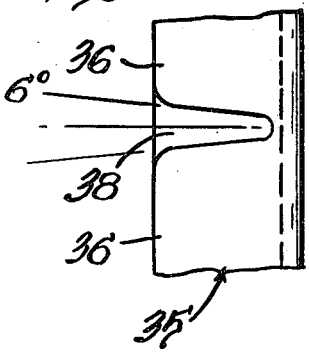
FIG. 4 is a partial view taken along lines 4—4 of FIG. 3.

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

The decorative attachment or framing member 10 incorporating the present invention is shown in the drawings framing a fixture assembly 12 that is adapted to be affixed to the surface such as a wall 14. One type of article with which the framing member of the present invention has particular application is the fixture assembly such as is shown in U.S. Pat. No. 3,848,843 and sold by Applicant's assignee under the trademark MAGIC CIRCLE.

Such an assembly is shown in the above mentioned patent, and includes a support plate 16 which is affixed to the surface of the wall 14 such as by an adhesive or suitable mechanical fastener. The support plate 16 has a peripheral outwardly extending annular flange 18 spaced from the wall 14 over which the fixture 20 is mounted. The flange 18 is adapted to receive and interengage with a connecting member 22 having a retaining element in the form of a partial annular radially extending flange 24 and a lip 26 extending parallel to the surface of the support flange 16 and interengagable therewith.

In assembly, the support plate 16 is first affixed to the surface 14. Thereafter, the fixture 20 is affixed by sliding in a direction generally parallel to the surface 14 as indicated by the arrow 27 in FIG. 5 until the two pieces interengage to retain the fixture 20 on the support plate 16. As shown more clearly in the above cited patent, the periphery of the fixture itself does not extend all the way around the support plate and therefore some spaces exist around the periphery of the fixture which is not always desirable from a decorative point of view.

In accordance with the present invention, the framing member or decorative article 10 incorporating the present invention is adapted to be placed around the periphery of such a fixture 20 or any other article to enhance its decorative appearance and to provide those other functions a frame provides.

Products such as the fixture described above, are mass produced such as by injection molding and the dimensions of each such product varies to some degree. A framing member 10 incorporating the present invention is adapted to merely slide onto the framed article and to be retained in place frictionally without any other attachment mechanisms.

Figure 5:
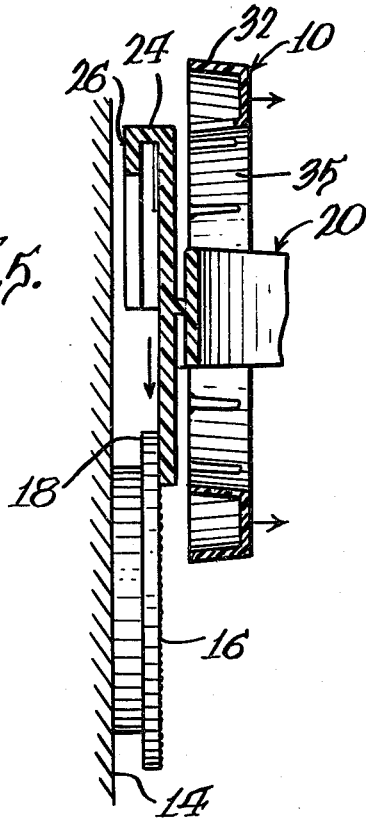
FIG. 5 illustrates one method of installation of an article to be framed and the framing member.
Figure 6:
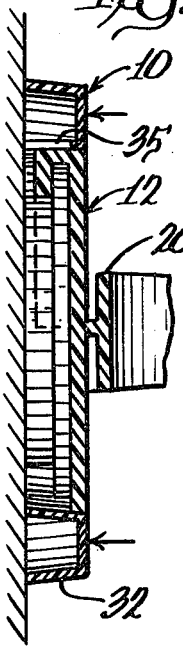
FIG. 6 is a sectional view showing the completed installation of the article and framing member in place.

In the case of the fixture 20 shown in the drawing, not only is it necessary to displace the framing member 10 onto the article being framed it may also be necessary to push the framing member past the article (to the right as shown in FIG. 5) in order to permit the transverse displacement of the article itself in being affixed to the support plate. After such attachment of the fixture to the support plate, the framing member is displaced rearwardly over the article being framed into position against the surface 14 on which the framed article is mounted.

It is desirable, therefore, that the framing member be displaceable over the surface of the framed article in two directions without excess force being required and at the same time be retained in place when in position securely and without incidental movement.

In order to achieve this, the framing member, which includes a decorative front surface or face 30, and a decorative outer surface 32, also includes an inner article engaging surface portion 32 adapted to frictionally engage the outer surface of the article being framed to permit transverse movement with respect thereto, and to simultaneously provide the desired frictional engagement for retaining the framing member in its desired position.

As shown in the drawing, the inner article engaging surface portion 35 is tapered from a maximum ID dimension between the opposite sides of the inner surface adjacent the front or decorative face 30 to a smaller ID adjacent the inner or back edge of the inner object contacting portion 35. In addition, the inner article engaging portion 35 may be divided into a plurality of segments or tabs 36 by a plurality of radial slots 38 which provide sufficient flexibility to the inner surface to allow it to flex as it passes over the article and to simultaneously retain sufficient rigidity and elasticity to tightly engage the framed article and retain the framing member in place when in position.

This is all the more difficult because of the varying dimensions and shapes of which the framing member of the present invention may take and because of different materials from which such a framing member can be fabricated.

In accordance with the present invention it has been determined that appropriate configuration of the inner article contacting portion 35 can be determined in accordance with the follwing formulas. The angle of taper of the contact surface is satisfactory if it is constructed in accordance with the following formula $$L=(POD_{max}-POD_{min})/(0.035\times H)$$

where

L equals the angle of the contact surface for a proper interference fit;

$POD_{max}$ equals the maximum dimension of the outer surface of the product being framed which is intended to engage the contact surface of the framing member;

$POD_{min}$ equals the minimum dimension of that product surface; and

H equals the height of the contact surface of the product.

The numerical factor represents the rise per degree inch of $0.0175\times 2$ for both sides of the contacting surface of the framing member.

The thickness of the flexible product contacting wall member of the framing member is determined by the following formula:

$$T=(2\times F_{max})/(S\times FS)$$

where

T equals the thickness of the material forming the contact surface of the framing member;

$F_{max}$ equals the maximum holding force required;

S equals the surface area of the contact surface; and

FS equals the flex strength in psi/in.$^2$ to break or yield of the material.

Finally, in curvalinear surfaces the spacing between the segments or tabs is equal to one half the radius of the curved surface.

A article conforming to the above conditions, will be retained in place, the holding surfaces will retain sufficient flexibility to permit the ready displacement of the framing member off of over and onto the product being framed while retaining sufficient holding power to keep the framing member securely in place without movement or inadvertent loss of position and will not require excess force in order to insert the framing member into place by the consumer who must make the installation without the use of any special tools.

In one embodiment of the framing member incorporating the present invention, the article being framed such as that shown in the drawing was generally circular having a mean diameter of about 2.31 inches. The taper of the inner article contact portion was about 6° to accommodate maximum diameter of the article being framed of about 2.33 inches and a minimum diameter of about 2.29 inches. The article being framed had a contact surface height of about 3/16 inch.

In such a example, it was empirically determined that a maximum holding force of about 6 pounds/in$^2$ was required to retain the framing member in place on the article without requiring excess force for insertion of the framing member about the article, the contact area was about 0.036 inch and the flex strength of the plastic material utilized in forming the framing member was about 8300 psi per ASTM TEST 7900. The resulting tab thickness was about 0.040 inch. For the specific product identified above, the peripheral spacing of the tabs or discrete segments was about 30.

Thus there has been disclosed a decorative framing member adapted to be inserted over a wide variety of articles having a variety of dimensions and shapes in which the article engaging inner surface of the framing member is designed to frictionally engage and be retained on the article being framed while simultaneously allowing displacement of the framing member when necessary to permit of ready installation and removal when desired without requiring any external fastening means for attaching the framing member to the article being framed.

The framing member incorporating the present invention can have any suitable shape with the inner diameter article engaging surface conforming to the configuration of the article being framed while simultaneously having an outer configuration that is suitable for decorative purposes and does not necessarily conform to the shape of the article being framed.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An integral decorative framing member adapted to be placed around and frictionally retained on a generally rigid article being framed comprising:

a decorative external portion defining front and outer decorative surfaces; and an inner article engaging portion for engagement with the outer peripheral surface of the article being framed;

said inner article engaging portion being integral with and joined to said front surface and defining an aperture therewithin having a configuration corresponding to the shape of the article being framed, said aperture having a variable dimension between the inner article engaging portion disposed on opposite sides thereof;

said inner article engaging portion being tapered to define a maximum dimension of said aperture adjacent the junction of said inner article engaging portion with said front surface of said framing member and a minimum dimension of said aperture adjacent the rear end of said inner article engaging portion;

said inner article engaging portion being formed as a plurality of discrete segments having flexibility permitting passage of said framing member around said article without distortion of said front and outer decorative surfaces and resiliency to effect a gripping force for retaining said framing member in place on said article.

2. An integral decorative framing member as claimed in claim 1 wherein:

said maximum dimension of said aperture is not less than the maximum corresponding dimension of the article to be framed.

3. An integral decorative framing member as claimed in claim 1 or 2 wherein:

said minimum dimension of said aperture is less than the minimum dimension of the article to be framed.

4. An integral decorative framing member as claimed in claim 1 wherein the outer peripheral configuration of said framing member is substantially the same shape as the shape of the article being framed.

5. An integral decorative framing member as claimed in claim 1 wherein:

the angle of the taper of said innner article contacting portion is defined by the formula:

$$L=(POD_{max}-POD_{min})/(0.35\times h)$$

where

L equals the angle of the contact surface for a proper interference fit;

$POD_{max}$ is the maximum dimension of the outer surface of the product being framed which is intended to engage the contact surface;

$POD_{min}$ is the minimum dimension of the identical product surface; and

H is the height of the contact surface of the product.

6. An integral decorative framing member as claimed in claim 1 wherein the thickness of the material from which the inner article contacting portion is formed is defined by the formula:

$$T=(2\times F_{max})/(S\times FS)$$

where

T equals the thickness of the material forming the contact surface of the framing member;

$F_{max}$ equals the maximum holding force required;

S equals the surface area of the contact surface; and

FS equals the flex strength in psi/in$^2$.

7. An integral decorative framing member as claimed in claim 1 wherein:

the configuration of the article being framed is curvalinear and the separation of said discrete segments is about one half of the radius of curvature of said article.

8. An integral decorative framing member as claimed in claim 1 adapted to be inserted around the article being framed from either the front or back thereof.

* * * * *